US009118113B2

(12) United States Patent
Mortazawi et al.

(10) Patent No.: US 9,118,113 B2
(45) Date of Patent: Aug. 25, 2015

(54) PHASED ANTENNA ARRAYS USING A SINGLE PHASE SHIFTER

(75) Inventors: Amir Mortazawi, Ann Arbor, MI (US); Danial Ehyaie, San Francisco, CA (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 319 days.

(21) Appl. No.: 13/113,740

(22) Filed: May 23, 2011

(65) Prior Publication Data

US 2012/0050107 A1 Mar. 1, 2012

Related U.S. Application Data

(60) Provisional application No. 61/347,227, filed on May 21, 2010.

(51) Int. Cl.
*H01Q 3/30* (2006.01)
*H01Q 21/00* (2006.01)

(52) U.S. Cl.
CPC ..... *H01Q 3/30* (2013.01); *H01Q 21/0006* (2013.01)

(58) Field of Classification Search
USPC ..... 342/370–372; 343/853, 855
IPC ..... H01Q 3/2647,21/0006
See application file for complete search history.

(56) References Cited

U.S. PATENT DOCUMENTS 3,277,481 A * 10/1966 Robin et al. ..... 342/373
3,340,530 A * 9/1967 Sullivan et al. ..... 342/370
3,354,459 A * 11/1967 Schwartz et al. ..... 342/362
3,757,335 A * 9/1973 Gruenberg ..... 342/367
3,803,625 A 4/1974 Nemit
7,602,337 B2 10/2009 Choi et al.
7,683,833 B2 3/2010 Floyd et al.

OTHER PUBLICATIONS

J. De Los Santos, Introduction to Microelectromechanical (MEM) Microwave Systems, Artech House, p. 159-195, 1999.*
Power divider, McGraw-Hill Dictionary of Scientific and Technical Terms, 6th edition, The McGraw-Hill Companies, Inc., http://www.answers.com/topic/power-divider, 2002.*
Waveguide, McGraw-Hill Encyclopedia of Science and Technology, 5th edition, The McGraw-Hill Companies, Inc., http://www.answers.com/topic/waveguide, 2004.*
Wireless Networking in the Developing World, Second Edition, Hacker Friendly LLC, p. 95-134, 2007.*
Abbaspour-Tamijani, et al., An Affordable Millimeter-wave beam-steerable antenna using planar sub-arrays, IEEE Trans. Antennas Propag., vol. 51, issue 9, pp. 2193-2202 (2003).
(Continued)

*Primary Examiner* — Tashiana Adams
*Assistant Examiner* — Fred H Mull
(74) *Attorney, Agent, or Firm* — Marshall, Gerstein & Borun LLP

(57) ABSTRACT

Techniques for the design of low cost, low complexity phased arrays are described. The techniques allow control of the phase progression in the entire phased array by using only one phase shifter for a bank of arrays. In some examples, the phased array includes directional couplers, amplifying stages, power combiners and a phase shifter. The phase shifter may be of various kinds, including simple and compact phase shifters formed of varactor diodes and inductors or transmission lines.

15 Claims, 19 Drawing Sheets

(56) References Cited

OTHER PUBLICATIONS

Buckwalter et al., An integrated subharmonic coupled-oscillator scheme for a 60-GHz phased-array transmitter, IEEE Transactions on Microwave Theory and Techniques, 54(12), part 2, pp. 4271-4280 (2006).
Chung et al., Light weight mimo phased arrays with beam steering capabilities using RF mems, The 18th Annual IEEE International Symposium on Personal, Indoor and Mobile Radio Communications (PIMRC '07) (2007).
Ehyaie et al., A modular extended resonance transmit phased array with improved scan angle, IEEE. MTT-S International, pp. 1557-1560 (2009).
Ehyaie et al., Wide-scan angle extended resonance phased array, URSI General Assembly, Aug. 2008.
Kim et al., A heterodyne-scan phased array antenna, IEEE Microwave and Guided Wave Letters, 9:535-537 (1999).
Nishio et al., A frequency-controlled active phased array, IEEE Microwave Wireless Comp. Lett., 14:115-117 (2004).
Sun et al., Fast beamforming of electronically steerable parasitic array radiator antennas: Theory and experiment, IEEE Trans. Antennas Propag., 52(7):1819-1832 (2004).
Suzuki et al., Beam forming for large-scale phased array antennas, 20th AIAA International Communication Satellite Systems Conference and Exhibit, Montreal Quebec Canada, May 12-15, 2002.
Tombak et al., A novel low-cost beam-steering technique based on the extended-resonance power-dividing method, IEEE. Transactions on Microwave Theory and Techniques, 52(2):664-670 (2004).
York et al., Injection- and phase-locking technique for beam control, IEEE Trans. Microwave Theory Tech., 46:1920-1929 (1998).

* cited by examiner

PHASED ANTENNA ARRAYS USING A SINGLE PHASE SHIFTER

CROSS REFERENCE TO RELATED APPLICATIONS

This application claims the benefit of U.S. Provisional Application No. 61/347,227, filed May 21, 2010, the entirety of which is expressly incorporated herein by reference.

BACKGROUND OF THE DISCLOSURE

Field of the Disclosure

Phased array is a group of antennas in which the relative phases of respective signals feeding the antennas are varied electronically in such a way that the effective radiation pattern of the array is reinforced in a desired direction and suppressed in undesired directions. The direction of phased array radiation can be electronically steered obviating the need for any mechanical rotation.

Phased arrays have been widely employed in the military radar applications for decades. Recent growth in civilian radar-based sensors and communication circuits has drawn an increasing interest in the use of the phased array technology in commercial arena. For instance, phased arrays can be utilized in wireless local area networks and vehicular-radar based sensors, as well as emerging biomedical applications for cancer detection.

Despite the broad range of potential phased array applications, phased array technology has not been widely deployed in the commercial arena. The high cost of phased arrays is the primary impediment to their deployment in any large-scale commercial application. Thus, any substantial reduction in the cost of phased array systems will facilitate their much wider use.

A major cost of phased arrays can be largely attributed to the cost of their phase shifters. In fact, it is not unusual for the cost of the phase shifters and their control circuitry to represent more than half of the total cost of the entire phased array. Thus, in order to reduce the cost of phased arrays, ongoing efforts are underway to develop new architectures that allow the number of phase shifters to be reduced.

A common approach to reduce the number of required phase shifters is to group the radiating elements into a number of sub-arrays, where each sub-array would use a single phase shifter (see, e.g., U.S. Pat. No. 3,802,625). In this approach the linear-phase profile of the array excitation is replaced by a coarse stair-case approximation. However the increase in side lobes and grating lobes due to such an approximation severely limits the scan range of the array.

Another beam steering technique has been described by R. F. Harrington, "Reactively controlled directive arrays," *IEEE Trans. Antennas Propagation*, vol. AP-26, p. 390, 1978. In this technique, signal beam-forming and antenna tuning is achieved by an array of parasitic radiators, where phase shifters have been replaced with individual varactors. This method of beam steering relies on the radiation from a parasitic radiator coupled to a primary fed radiator. A relatively low level of parasitic radiation can considerably limit the achievable directivity of such arrays even if a large number of radiation elements are incorporated.

In yet another approach (see, T. Nishio, H. Xin, Y. Wang, and T. Itoh, "A frequency-controlled beam steering array with mixing frequency compensation for multi channel application," *IEEE Transaction on Antenna and Propagation*., vol. 52, pp. 1039-1048, April. 2004), a frequency-controlled scanning has been exploited to realize a phase-shifter-less phased array. However, this method relies on tuning the frequency to change the phase of signal at each array element resulting in limited array frequency bandwidth.

A different method to reduce the number of phase shifters is based on controlling the phase progression in an array by detuning the peripheral elements in an array of free running coupled oscillators (see, R. A. York and T. Itoh, "Injection- and phase-locking technique for beam control," *IEEE Trans. Microwave Theory Tech.*, vol. 46, pp. 1920-1929. November 1998). However, this method is susceptible to stability and multimoding issues common to coupled oscillator systems.

There is a need for reducing the number of phase shifters in a cost effective manner.

SUMMARY OF THE INVENTION

In accordance with an embodiment, a phased array includes a plurality of antennas; a feed network comprising a plurality of coupling stages each coupled to one of the plurality of antennas for coupling a respective portion of a first traveling signal to each of the antennas; and a phase shifting stage to provide a phase shift between the first and the second traveling signal, wherein the second traveling signal is injected into the feed network in the opposite direction to the first travelling signal so that each coupling stage couples a respective portion of the second traveling signal to the respective antenna.

In accordance with another example, a phased array includes a plurality of antennas; a feed network comprising a plurality of coupling stages to superimpose respective portions of two signals travelling in opposite directions, wherein the two signals are first produced by splitting the input signal of the phased array and then are fed to the feed network from the two opposite ends; and a phase shifting stage to control the relative phase shift between the two signals travelling in the feed network.

In accordance with yet another example, a phased array includes a plurality of antennas; a feed network to receive a signal from each antenna and to split the received signal from each antenna into two components and combine a respective portion of each components, wherein the respective portion of the first components are coupled into a feed line and combined coherently traveling in a first direction and the second components are coupled into the feed line and combined coherently traveling in an opposite direction; and a phase shifting stage to apply a phase shift to the combined second components, relative to the combined first components, at one of the two ends of the feed network.

In accordance yet a further example, a phased array includes a plurality of antennas; a feed network comprising two signal paths that are coupled to each other with a plurality of coupling stages; and a phase shifting stage to control the phase shift between the signals travelling on the two paths of the feed network.

In accordance with another example, a phased array comprises a plurality of antennas; a feed network comprising two signal paths that are coupled to each other with a plurality of coupling stages to receive a signal from antenna, wherein the received signal is then coupled to either of the two signal paths; and a phase shifting stage to control the phase shift between the signals travelling on the two paths of the feed network.

In accordance with another example, a phased array includes a plurality of radiative elements; and a feed network comprising two power dividing stages and a phase shifting stage to control the phase shift between the signals applied to the inputs of each power dividing stage.

In accordance with another example, a phased array includes a plurality of radiative elements; a feed network comprising two power combining stages; and a phase shifting stage to control the phase shift between the combined signal at the outputs of each power combing stage.

In accordance with another example, a repeatable phased array element including an array module comprising a plurality of antennas and a feed network for combining a forward traveling input signal and a reverse traveling, phase shifted input signal as combined input signals for the plurality of antennas; and a phase shifter stage to phase shift the forward travelling input signal at one end of the feed network and inject a portion of that in reverse direction into the feed network, and, inject the other portion into the subsequent array module if a subsequent array module is connected to an output of the phase shifter stage.

In accordance with yet another example, a phased array ncludes a plurality of antenna elements; a feed network for producing first signal components and second signal components and combining them to provide combined signal components feeding each of the antenna elements; and a phase shifter to control the phase shift between the first signal components and second signal components and distributed along the feed network so that each of the combined signal components has the same phase but a different amplitude.

DETAILED DESCRIPTION

Figure 1A:
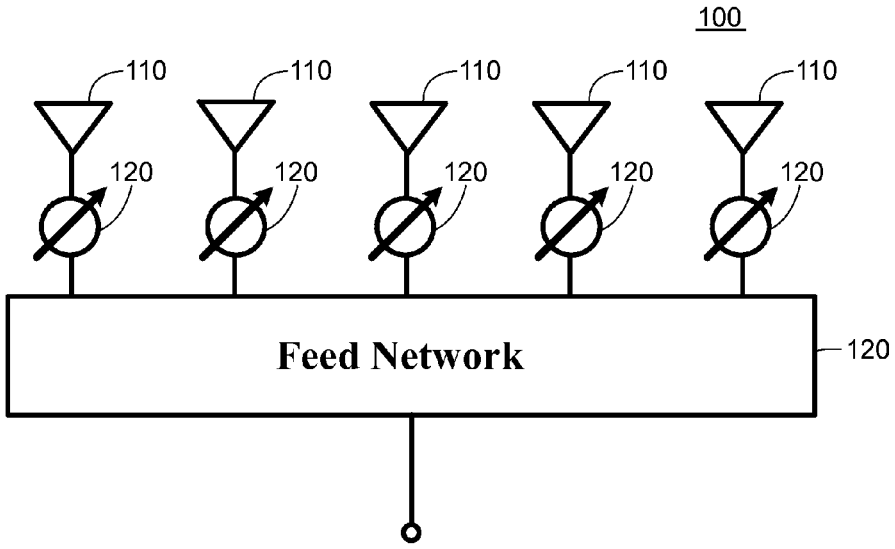
FIG. 1A (Prior Art)
FIG. 1A is a block level illustration of a conventional design of phased arrays requiring a separate phase shifter for each antenna element.
Figure 1B:
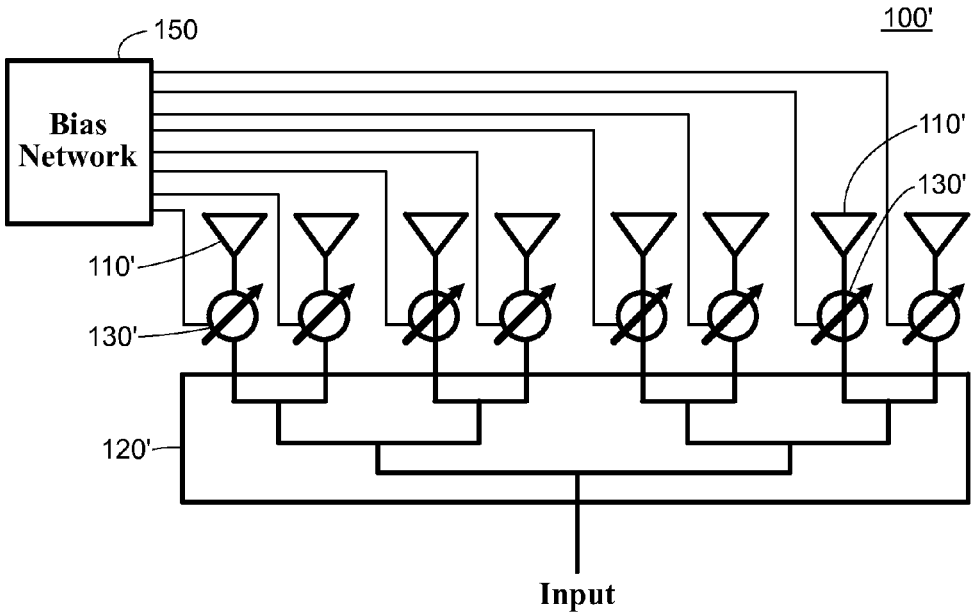
FIG. 1B (Prior Art)
FIG. 1B illustrates an example of the design of FIG. 1A in a parallel-fed phased array configuration.

Conventional phased arrays are typically implemented in one of two configurations: parallel-fed phased arrays or series-fed phased arrays. FIG. 1A illustrates a general example of a phased array 100 having multiple antenna elements 110 and a feed network 120 that supplies signals to the antenna elements, where a separate phase shifter 130 is used for each antenna element 110. FIG. 1B illustrates a phased array 100' which is an example implementation of the configuration of FIG. 1A in a parallel-fed phased array configuration. In this configuration, the feed network 120' is a multilevel divider network having an input feeding a plurality of splitter elements defining the feed network 120'. The input signal is split using a number of power splitting (dividing) circuits that ultimately each feed an antenna element 110' in a parallel configuration. In the illustrated example, a three splitter level feed network 120' is provided, where generally the number of levels of splitters will depend upon the number of antenna elements. A bias network controller 150 controls operation of each of the phase shifters 130'.

Figure 1C:
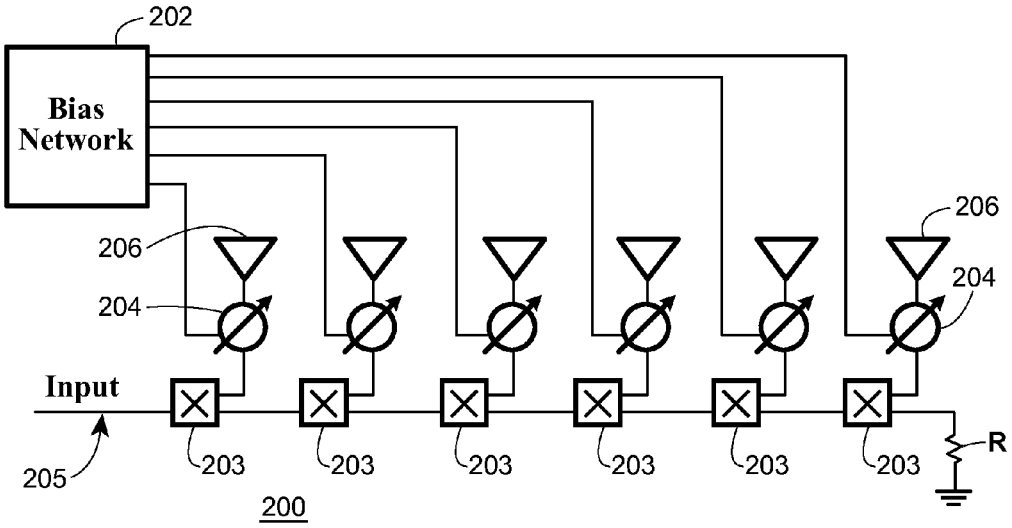
FIG. 1C (Prior Art)
FIG. 1C illustrates an example of the design of FIG. 1A in a series-fed phased array configuration.
Figure 1D:
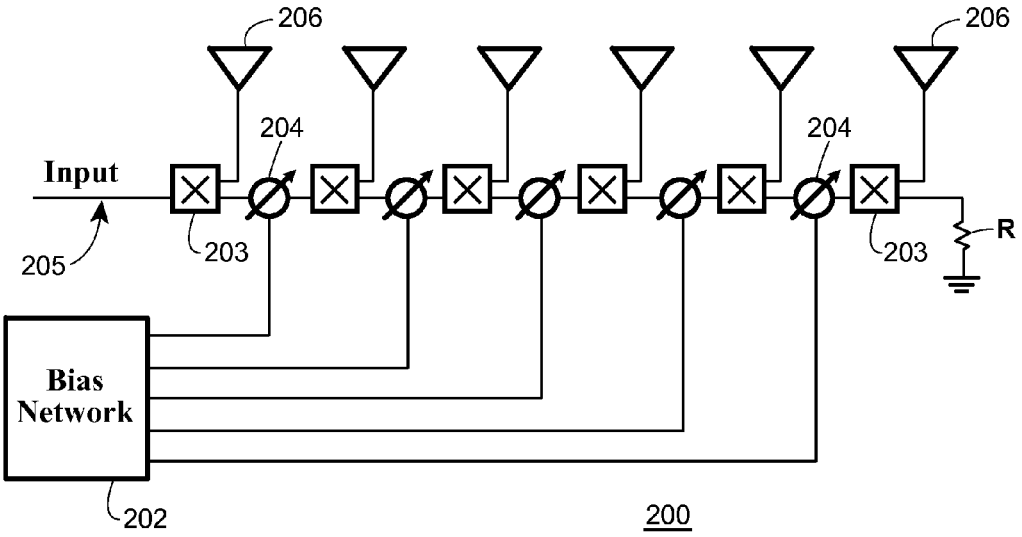
FIG. 1D (Prior Art)
FIG. 1D illustrates another example of the design of FIG. 1A in a series-fed phased array configuration.

FIG. 1C and FIG. 1D illustrate two example implementations, respectively, of phased arrays in a series-fed configuration. In FIG. 1C, for example, a phased array 200 uses an input signal received in a serial manner. A plurality of splitters 203 are maintained in a series connection and divide received input signal 205 and subsequent divided renditions thereof. Each splitter 203 couples a portion of its respective input signal into a respective phase shifter 204 and antenna element 206 pair. The phase shifters 204 are controlled by a bias network controller 202 to individually and properly provide the required phase shift to the signal feed to each antenna element 206 fed serially. The one end of the serial feed line is terminated by a resistor element, R to prevent reflections.

FIG. 1D illustrates another example, similar to that of FIG. 10, and thus bearing like reference numerals, but where each splitter stage feeds phase shifter 204 first before the splitter 204 couples a portion of the received signal into the respective array element 206.

Thus, as shown, in the serial-fed phased array configuration, the input signal 205 is fed into the phased array and distributed serially to the antennas, where the phase shifters may be placed before the antennas (FIG. 10) or along the feed-line (FIG. 1D) to provide the required phase tuning to the antenna elements.

The phased arrays described herein may be solid-state antenna devices or optical devices. For the former, solid-state splitter elements and phase shifts may be used; while for the former, optical splitters such as 3 dB coupled fibers, 3 dB tapered fiber branches, or planar lightwave circuits (PLC's) may be used. Optical phase shifters may be implemented in various ways, such as through the use of electro-optic devices.

The present application provides new techniques to phased array design. Unlike conventional phased arrays that require a separate phase shifter for each antenna element, phase progression may be controlled by using only one phase shifter with the present techniques. As a result, the cost and complexity of the phased arrays based on this design can be significantly reduced.

Figure 2:
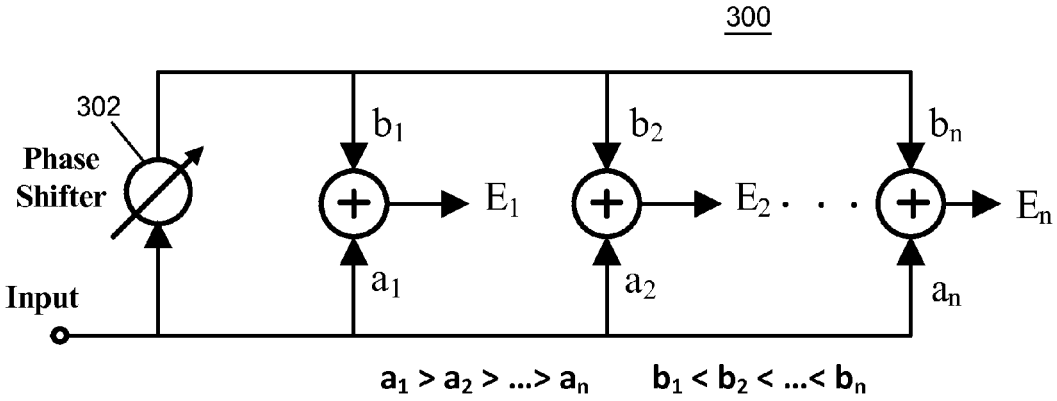
FIG. 2 is a block level illustration of a phased array configuration in accordance with an embodiment of the present techniques.

FIG. 2 illustrates an example phased array configuration 300 in accordance with the present examples. A single, phase shifter 302 is used to control the phase of a plurality of antenna elements, each represented by the antenna input signal $E_1$, $E_2$ . . . $E_n$. Each antenna input signal is the vector summation of two different corresponding signal components ($b_1$, $b_2$ . . . $b_n$ and $a_1$, $a_2$ . . . $a_n$). The signal at each radiating-element is the vector sum of the two corresponding signal components, $a_i$ and $b_i$, provided by distributing the input signal through two feed networks with unequal power division. The signals across each feed network are in phase (i.e., $a_1$, $a_2$ . . . $a_n$ are in phase with each other, and $b_1$, $b_2$ . . . $b_n$ are in phase with each other) while the phase difference between the two signal components ($a_n$ vs. $b_n$) in controlled by a single phase shifter. The amplitudes of the first signal components ($a_1$, $a_2$ . . . $a_n$) across the feed network decrease toward the end of the antenna array (i.e., $a_1>a_2>\ldots>a_n$) while the amplitudes of the second signal components increases toward the end of the antenna array FIG. 2 shows two signal components, with a phase shift provided by a phase shifter. And these two signal components are used to drive a plurality of radiating-elements, e.g., antennas.

Figure 3:
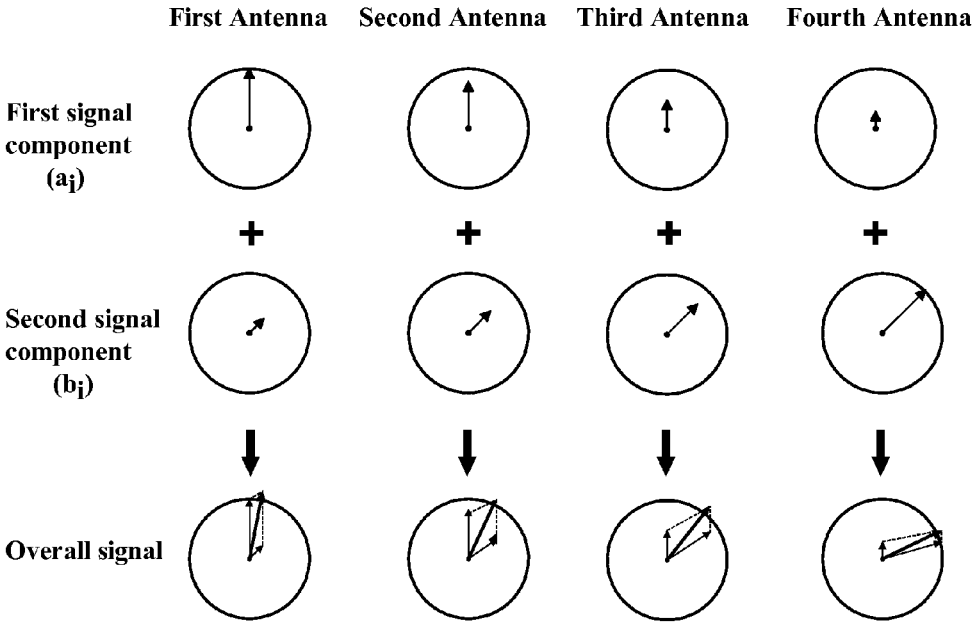
FIG. 3 illustrates the operation of a phased array configuration according to the present application and showing the amplitude and phase for different component signals.

FIG. 3 illustrates the phase and amplitude differences between the signals across each of two different feed networks (labeled a first signal component and a second signal component) and the resulting signal fed to four different antennas, where the position of the antennas from the input source is as identified.

The amount of the phase shift at each antenna element depends on the relative amplitude of the two signal components $a_i$ and $b_i$ at each radiating element (antenna). In an array with linear phase progression, the closer an antenna element is to the phased array input signal, the larger the amount of phase shift it would require. Therefore, the first signal component fed into each antenna element progressively decreases in amplitude, while the second signal component progressively increases in amplitude across the array. By providing appropriate amplitude tapering of $a_i$ and $b_i$ across the array, along with a single-phase shifter, a variable phase shift can be achieved as illustrated by the overall fed signal.

In the particular example, first, second, third and fourth antenna elements are depicted, and the first signal component ($a_i$) is illustrated along with the second signal component ($b_i$). The first components are all in phase but have decreasing amplitudes. The second components are all in phase but have increasing amplitudes. The increasing amplitudes can be realized by virtue of the difference in the propagation direction of the first components and the second components.

A phased array in accordance with the present teachings may be composed of couplers, amplifying stages, power dividers and two phase shifters, as illustrated and discussed.

Figure 4:
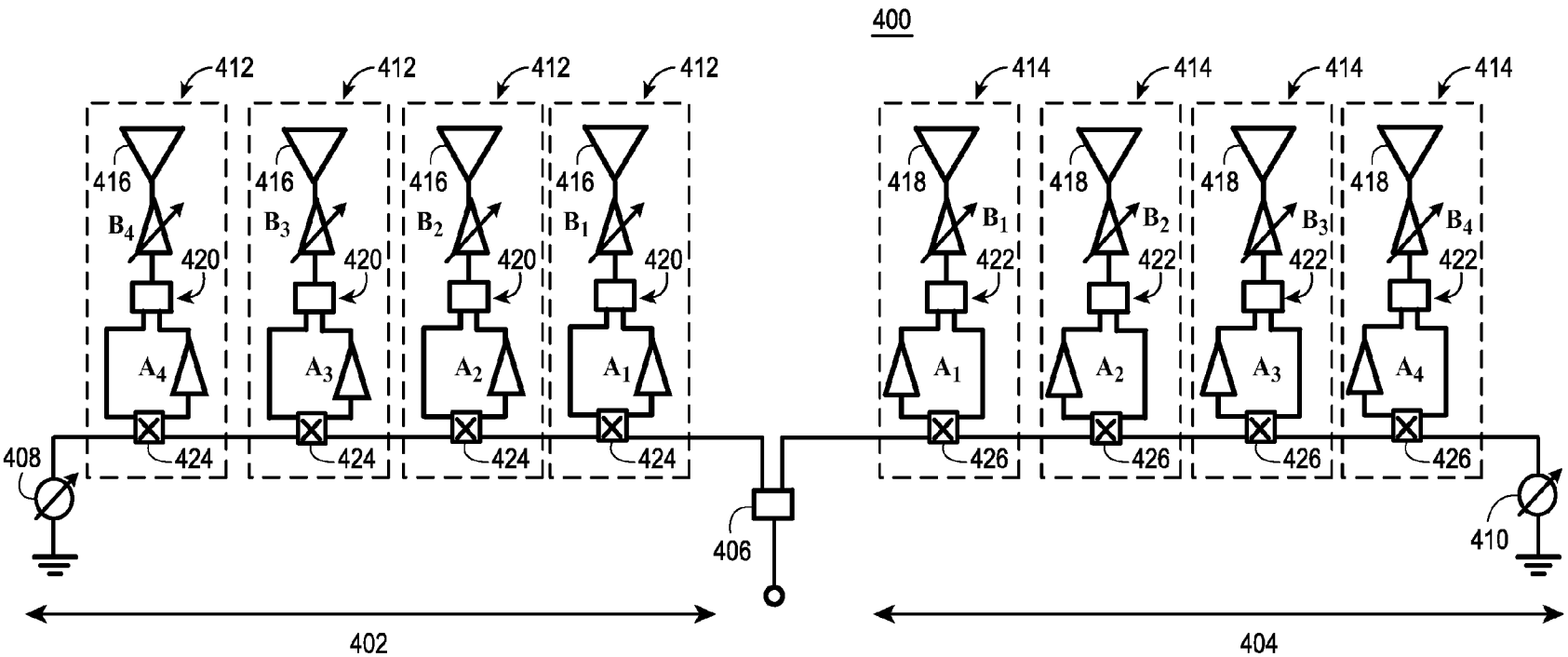
FIG. 4 illustrates a phased array circuit in the form of a symmetric array containing two sub-arrays, in accordance with an example.

A circuit diagram of an example phased array 400 is shown in FIG. 4. In this particular example, the phased array 400 is composed of two identical sub-arrays (one of the left 402 and one on the right 404), where the input signal is equally divided between them using a power divider 406. The opposite end of each fed sub-array 402, 404 is connected to a phase shifter 408, 410 respectively. Each phase shift reflects the incident signal back after providing a phase shift. The phase shifters may be implemented through various known ways, including through varactor diodes and inductors as illustrated below. More generally, any type of phase shifter including digital and analog phase shifters such as switched line, loaded transmission line and reflection type phase shifter can be used in the phased arrays discussed herein. The illustrated example illustrates multiple sub-arrays. It will be appreciated that the present techniques may be implemented with a single phase shifter feeding a plurality of antennas, alone or in various sub-array configurations.

Each sub-array 402, 404 comprises a plurality of antenna elements 412, 414, respectively, each antenna element having an antenna 416, 418, respectively, and corresponding input stages 420, 422, respectively, comprising amplifies ($A_1$-$A_n$ and $B_1$-$B_n$). The signal at each antenna port is the vector sum of the two signal components traveling in opposite directions along the respective feed network. The first signal component is coupled through a directional coupler's coupled port, while the second signal component is coupled through the isolated port of the coupler. Each input stage has a directional coupler. The first signal component at each antenna element has a fixed phase, which is maintained for all the antenna elements. However the second signal component has a variable phase controlled by the respective phase-shifter 408 or 410. The second signal component is generated by the first signal component propagating entirely along the feed network from splitter 406 to phase shift 408, which acts to reverse and phase shift the first signal component, thereby creating the second signal component propagating in the reverse direction along the feed network. A similar reflection and phase shift occurs on the other side.

By tuning the phase of the second signal component, a variable progressive phase-shift across the sub-array can be achieved. FIG. 3 shows the operation theory of the phased array. The amount of the phase shift at each antenna element depends on the relative amplitude of the two signal components. In an array with linear phase progression, the closer an antenna element is to the phased array input, the larger the amount of phase shift it would require. Therefore, as the amplitude of the first component of the signal decreases, the amplitude of the second component increases. To provide proper signal amplitudes across the array, 3 dB hybrid couplers 424, 426, respectively, may be used in the design. Furthermore, in order to compensate for the amplitude difference between the input signal and the reflected signal by the phase shifter, amplifiers $A_1$ . . . $A_4$ with appropriate gains are incorporated in the design. The signal at each antenna port is the vector sum of the two signal components, therefore by tuning the phase of one component the overall amplitude varies.

The reflected signal component, i.e., from the respective phase shifter 408, 410, is amplified by an amplifier, $A_i$, before the signal is combined with the first signal component, which propagates up through the non-amplified branch of the elements 412, 414. To maintain the amplitude of the signal at each array element, variable-gain amplifiers $B_1$ . . . $B_4$ are employed before the antenna elements.

As shown in FIG. 4, the symmetric array may contain two sub-arrays 402 and 404. In order to achieve a linear phase progression throughout the entire array, one sub-array is provided with a progressively increasing positive phase shift while at the same time, the second sub-array needs a progressive negative phase shift. In any example, the array is designed to provide a broadside beam at the mid-point of phase shifters tuning range.

Figure 5A:
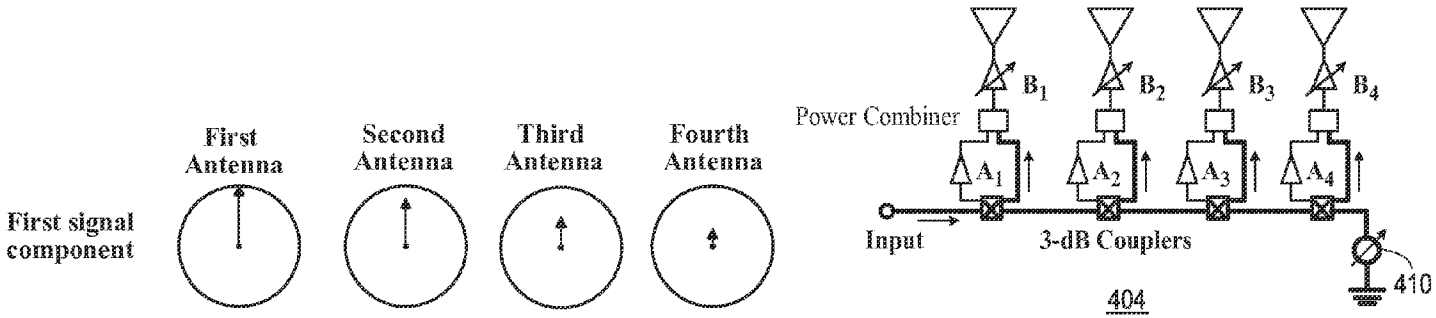
FIGS. 5A-5B illustrate example operation of the configuration of FIG. 4 for the first signal component (FIG. 5A), the second signal component (FIG. 5B), and the combined signal components (FIG. 5C).
Figure 5B:
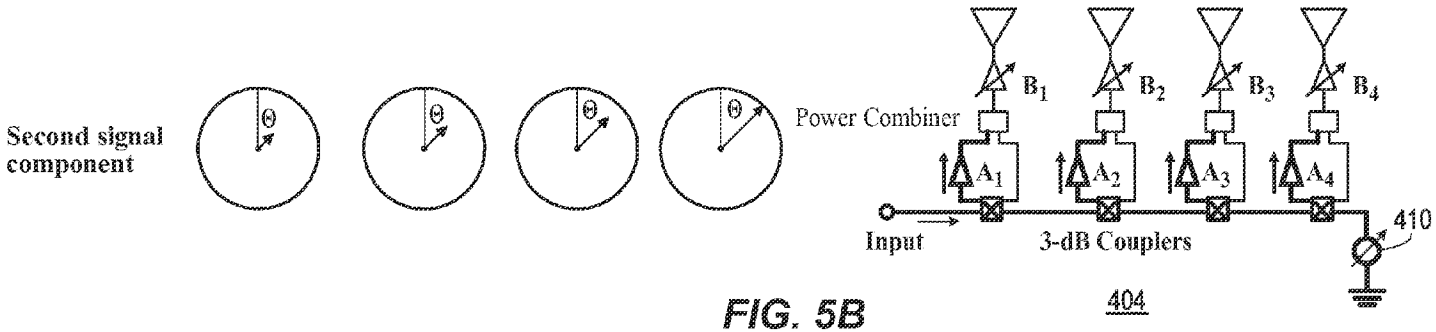
Figure 5C:
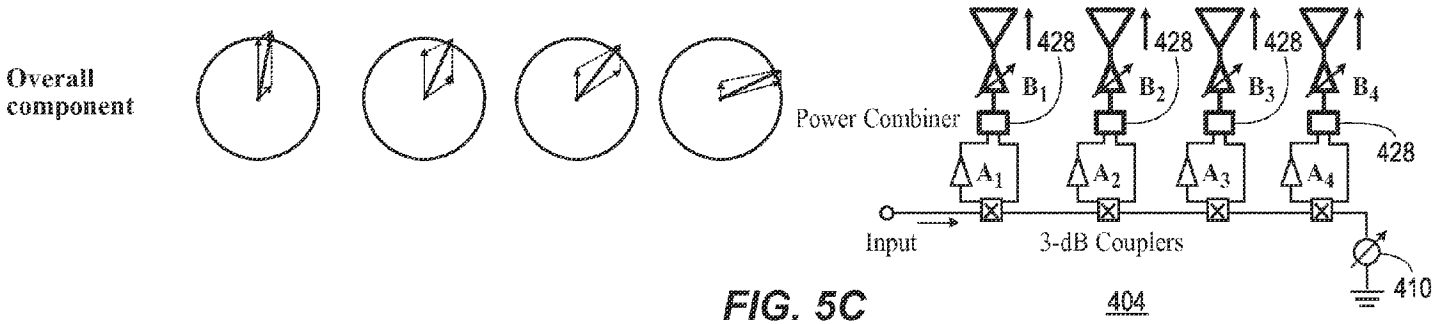

FIGS. 5A-5C illustrates the operation and signal propagation path of the configuration of FIG. 4 for the first and second signal components. FIG. 5A illustrates the propagation of the first signal components from the splitter to the phase shifter 410. FIG. 5B illustrates the propagation of the second signal components from the phase shifter back toward the splitter, coupling into amplifier ($A_1$-$A_4$) branches of the antenna element stages. FIG. 5C illustrates the combining of the first and second signal components, through power combiners 428, into the variable gain amplifier stages ($B_1$-$B_4$).

Figure 6:
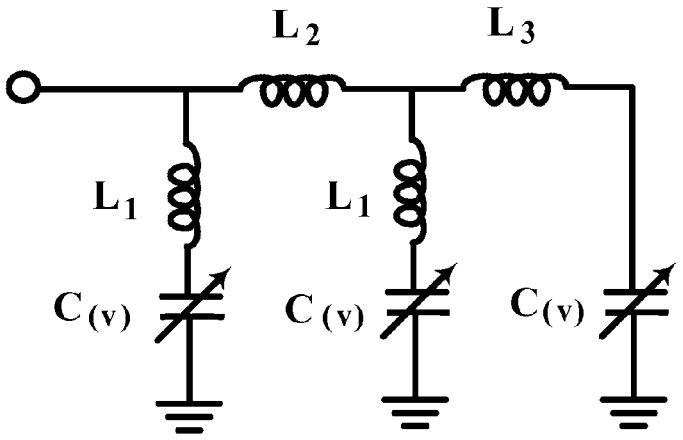
FIG. 6 illustrates a phase shifter circuit in accordance with an example herein.

The circuit structure of an example phase shifter is shown in FIG. 6, although the present techniques are not limited to any particular phase shifter configuration. For the illustrated example, the phase shifter circuit is designed using several varactor diodes and lumped inductors. The phase shifter behaves like an open circuited transmission line with an adjustable electrical length. The effective electrical length of the line can be controlled by tuning the varactor capacitance. The amount of phase shift can be controlled by varying a single bias voltage applied to the entire circuit. Merely by way of example, the varactor capacitance can be tuned from 0.3 pF to 1.2 pF. The inductance values for $L_1$, $L_2$ and $L_3$ may be 1.7 nH, 4.7 nH, and 7.1 nH, respectively. The resultant phase shift can be tuned from −150 to 150 degrees while the reflection loss varies from 1.5 dB to 1.8 dB within the entire tuning range.

Figure 7:
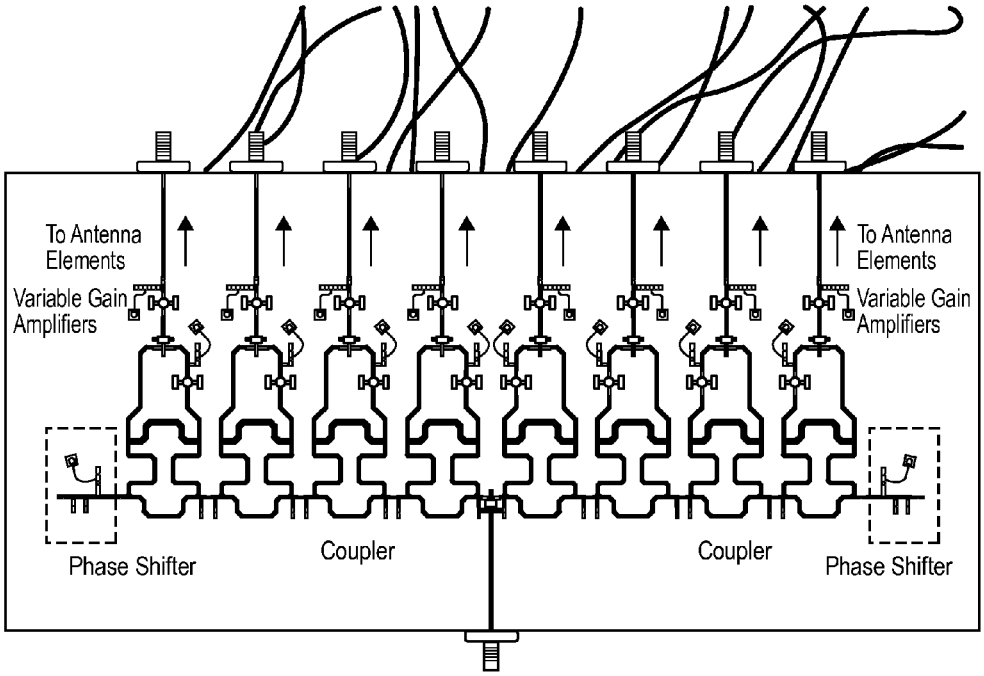
FIG. 7 illustrates an example eight-element phased array configured for 2 GHz operation.
Figure 8:
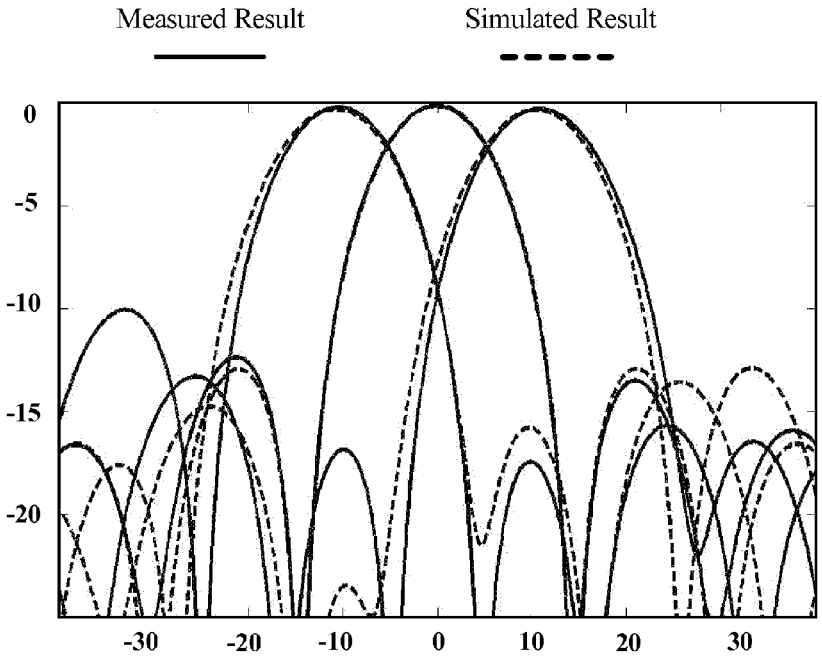
FIG. 8 is a plot of the ay factors corresponding to the configuration of FIG. 7.

An example of an eight-element phased array capable of operating at 2 GHz based on the present techniques is illustrated in FIG. 7. This example phased array was fabricated on a RO4003C circuit board, from ROGERS Corp., Chandler, Ariz., with a dielectric constant of 3.55 and a thickness of 20 mils. The 3-dB hybrid couplers were designed and implemented on the same substrate. The surface-mount power combiners SP-2U2+ from MINI-CIRCUITS, of Brooklyn, N.Y., were used to combine the power at each antenna element. The ERA2+ amplifiers from MINI-CIRCUITS were used to implement the fixed-gain stages while MGA-64135 amplifiers, from HEWLETT PACKARD, were used as the variable gain stages. The gain of this amplifier can be varied from 1 dB to 13 dB as its bias voltage is tuned from 8.5 to 13 volts. The varactor diodes used in the design of phase shifter were MA46H120 from MA/COM with a tunability of 4:1 and a quality factor of 50 at the design frequency. The varactor capacitance was tunable from 0.3 pF to 1.2 pF by varying its bias voltage from −0.5 volts to −15 volts. The lumped inductors used in the design of the phase shifting circuits were 0603CS-1N8XJL, 0603CS-4N7XJL and 0603CS-6N8XJL from COILCRAFT with inductance values of 1.7 nH, 4.7 nH and 7.1 nH and quality factors of 55, 60 and 80 respectively. Each phase shifter is tuned separately with a single bias voltage ranging between 0.5 to 15 volts. The S-parameters at each of the eight output ports are measured at various bias voltages and subsequently the corresponding array factors are calculated. In this example, a Scan angle of 25 degrees was achieved while the side-lobes were approximately 10 dB below the main beam. A plot of the array factors is illustrated in FIG. 8.

Figure 9:
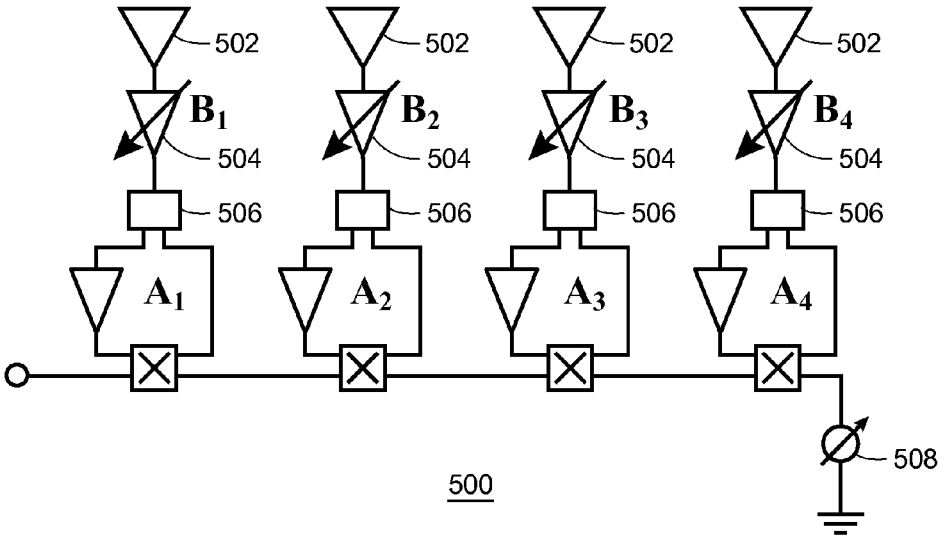
FIG. 9 illustrates an example implementation of a receive phased array.

FIG. 9 illustrates a phased array configuration similar to that of FIG. 4, but of a receiver phased array 500. The signal received at each antenna 502 is amplified through a variable gain amplifier 504 and then divided by a power divider 506 (e.g., taking the inverted path through of a power combiner) to form two received signal components, a first signal component and a second signal component. All first signal components from the antenna elements are combined while traveling along the feed-line toward the output. All second signal components are combined together while traveling along the feed-line toward phase shifter 508. The combined second signal components are phase shifted and reflected back into the feed-line. The overall signal, i.e., combined signal for the first signal components being added to the second signal components, is provided at the output to produce the received signal.

Figure 10A:
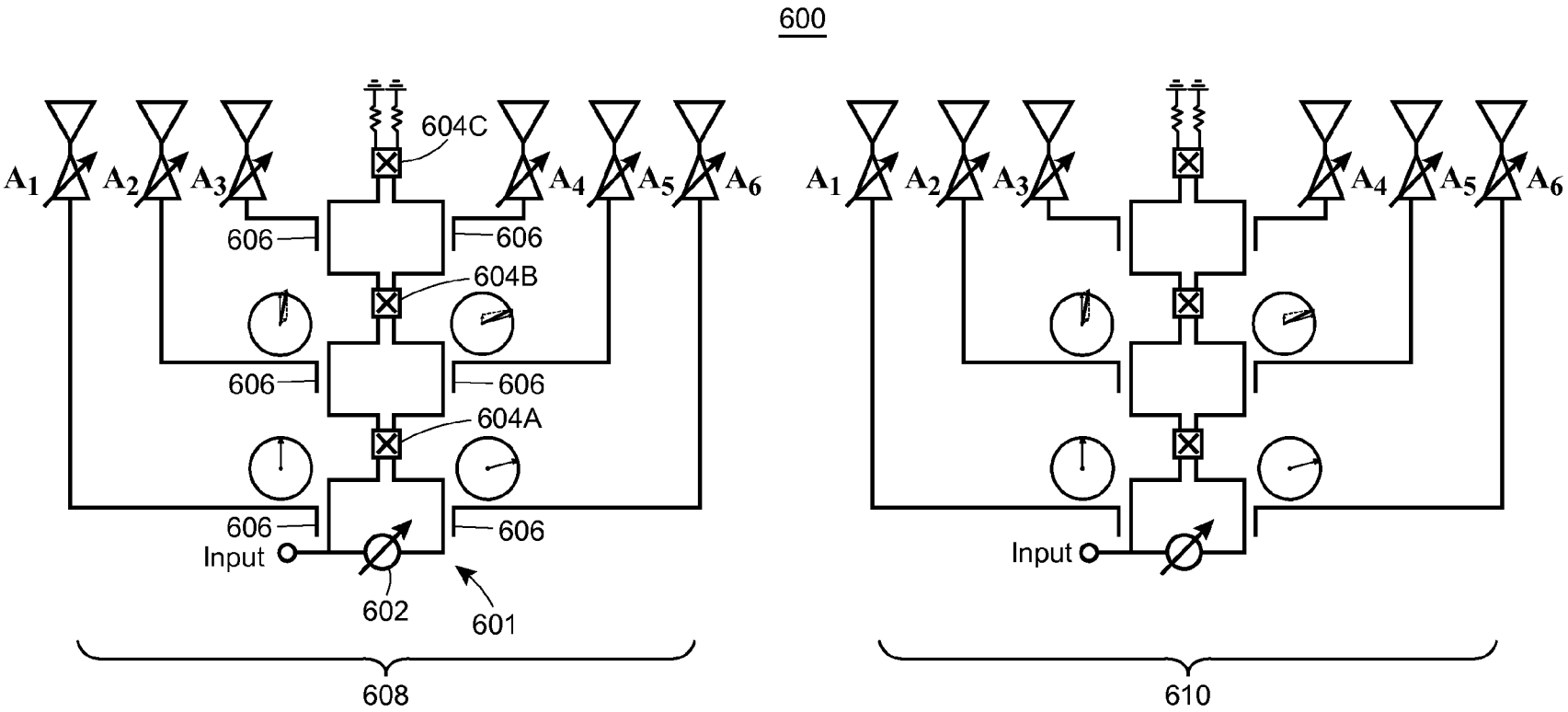
FIG. 10A illustrates another example implementation of a transmit phased array.

FIG. 10A illustrates another example of the present techniques as may be implemented for a transmitter phased arrays. In the illustrated example, an input signal is split into a first portion and a second portion.

For a transmit phased array 600, an input signal is divided into two components by a divider 601, where (by convention) a second component is passed through a phase shifter 602 while the first component is not. Each component travels in a separate signal path. The configuration includes a series of cross-couplers 604 (604A-604C), through which a portion of the signal on each path is coupled to the other path. And these combined signals are coupled, respectively, to the different antenna through directional couplers 606. For example, the combined signal that will be coupled into antenna $A_1$ (e.g., of array stage 608) comprises a arge portion of the signal along the first path added with a smaller portion of the signal from the second path, which has been cross-coupled into the feed line for $A_1$ by the first cross coupler 604A. This coupling continues up the chain, where the combined signal at the antenna $A_2$ is slightly phase shifted (the vector is rotated) relative to the combined signal into $A_1$, as shown in the figure. Through the second coupler 604B, another portion of the signal along the second path is coupled to the signal along the first path. Therefore, the signal at $A_3$ will be phase shifted even more (i.e., the vector is rotated a great extent). The corresponding effect on the antennas in the other side of the array 610 is shown. Thus the initial first signal component attenuates as it travels up the coupler chain, because each cross coupler taps a portion of that first signal component into the primary path of the second signal component. The same also occurs for the second signal component on the other side of the cross couplers.

Figure 10B:
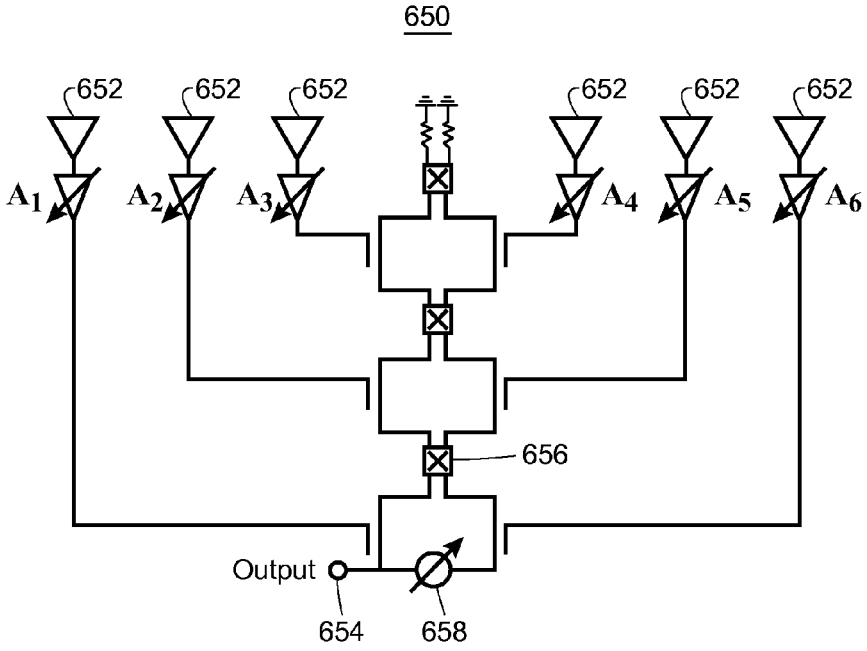
FIG. 10B illustrates an example implementation of a receive phased array having similar elements to that of FIG. 10A.

FIG. 10B illustrates a receiver phased array 650 formed of similar elements to those of the transmit phased array 600. In operation, a first antenna 652 receives a signal that is applied to a gain amplifier $A_1$ coupled directly to output port 654, that is, without a phase shifter. For the next antenna 652, the largest portion of the signal received at amplifier $A_2$ travels on a first path and reaches the output port 654 without phase shift, while a smaller portion of that received signal, from $A_2$, is coupled to a second path through a cross coupler 656 and phase shifted by phase shifter 658, before reaching the output port 654. The smaller portion of the signal received at $A_3$, compared to $A_2$, travels on the first path because the signal of $A_3$ is coupled to second path twice. Therefore, the larger portion of its received signal, compared to $A_2$, is phase shifted.

Figure 11:
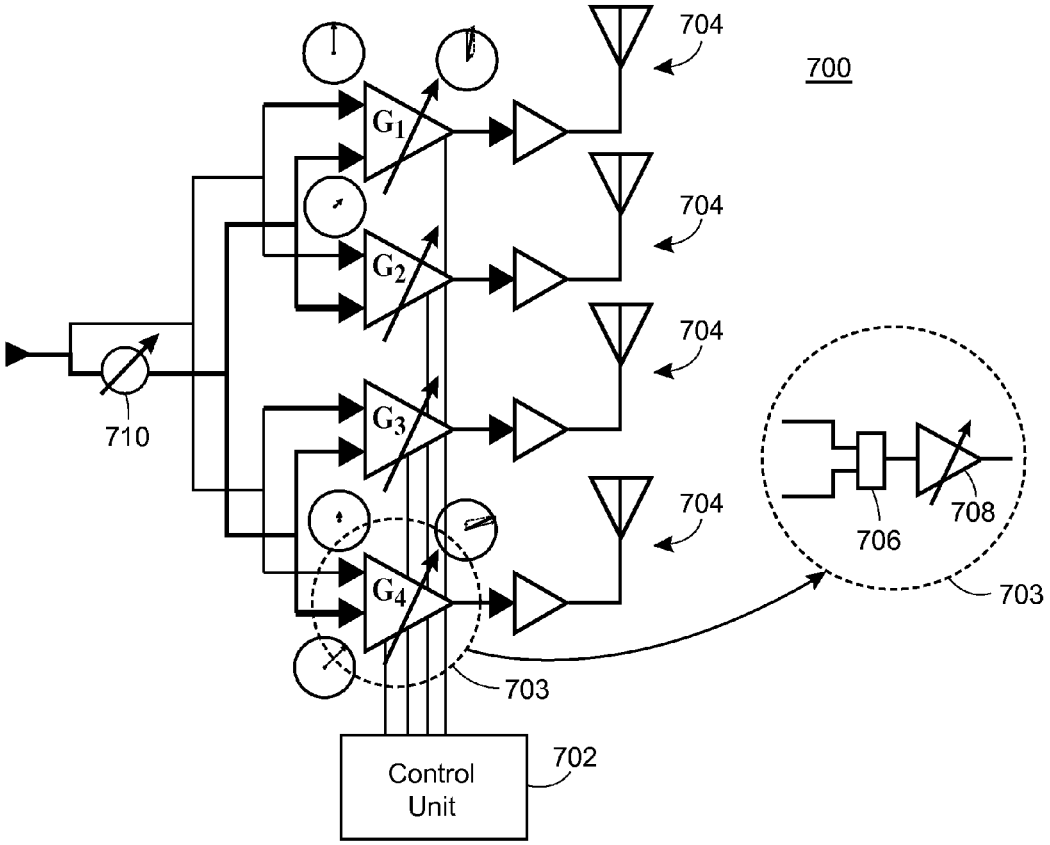
FIG. 11 illustrates an example implementation of a dual-mode phased array having both a transmit mode and a receive mode.

FIG. 11 illustrates yet another example configuration of transmit and receive phased arrays. A phased array 700 can function as both a transmit mode and a receive mode, where the modes are selectable using a control unit 702 to switch a circuit element from either a combiner, in the transmit mode, to a divider, in the receive mode. The control unit 702 controls each gain stage 703 of antenna elements 704, where each gain stage 703 includes a power combiner/splitter 706 and a bi-directional variable gain amplifier 708. The control unit 702 controls the overall signal flow direction of each stage 703, i.e., whether the stage is in transmit mode or receive mode, as well as the gain for each stage. Correspondingly, the applied gain, and direction of the gain, for the variable gain amplifier 708 is also controlled by the control unit 702, depending on whether the phased array is in a transmit mode or a receive mode.

For the transmit mode, the input signal is divided into two components, where the second component is phase shifted by phase shifter 710. Each component is injected into a separate power dividing stage, representatively shown. The power dividing for the first signal is designed such that largest portion of the signal reaches the top variable gain signal combiner and smallest portion reaches the bottom variable signal combiner. The power dividing stage for the second signal is designed such that the largest portion of the signal reaches the bottom variable signal combiner and the smallest portion reaches the top variable gain signal combiner as shown in FIG. 11. The relative power differences between signals are shown by way of example through using various thicknesses on the signal lines, whether thicker lines means more power. Therefore, the signal at the top antenna 704 experiences the least phase shift (the vector is rotated less); and the signal at the bottom antenna 704 experiences the largest phase shift (the vector is rotated most).

For the receive phased array, the configuration would be the same, except with the gain amplifiers 708 switched in direction and the combiners 706 acting as dividers. In operation, the signal received by at each antenna is divided into two components. In receive mode, the largest portion of the top antenna travels through the first power dividing stage (in which it will not be phase shifted) and small portion of the signal travels through the second power combining stage (in which it will be phase shifted). (The arrows showing signal directional flow in FIG. 11 are inverted for the receive phased array configuration.) A smaller portion of the signal at the lower antenna 704 compared to the one of the top antenna 704 travels in the first power dividing stage and larger portion goes to the second power dividing stage. Therefore overall the signal experiences larger phase shift.

Figure 12:
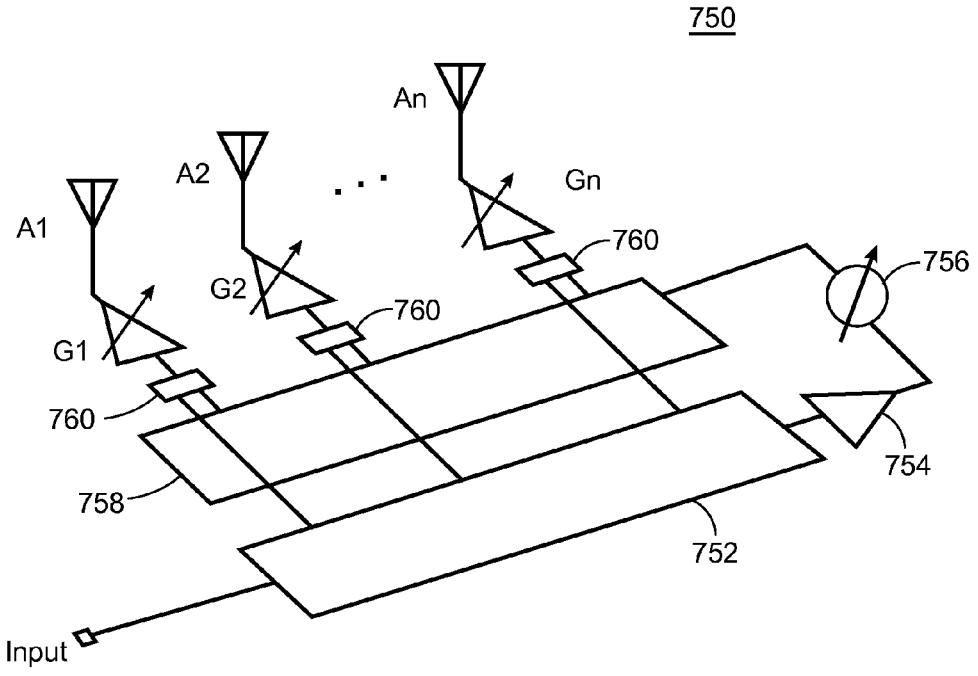
FIG. 12 illustrates another example transmit phased array.

As shown more generally in FIG. 12, for a transmit phased array 750, an input signal is fed into first power dividing stage 752, designed such that signal strength provided to the first variable-gain amplifier, $G_1$, is larger than the signal strength provided to the second variable gain amplifier, $G_2$, and so on. Furthermore, a portion of the output signal from the stage 752 is amplified by an amplifier 754 (if needed) and injected into a phase shifter stage 756. The output of the phase shifter 756 is then injected into a second power dividing stage 758, which is designed such that signal strength provided to the last variable-gain amplifier $G_n$ is larger than the signal strength provided to the variable gain amplifier $G_{n-1}$ and so on. Each gain stage, $G_1$-$G_n$, is fed by a respective signal combiner 760. Because the signals at the output of variable gain amplifiers are the vector sum of the two combined input signals, the signal to the first antenna $A_1$ exhibits the lowest amount of phase shift as compared to the signal input to the last antenna $A_n$. Therefore, by tuning the phase shifter, one can scan the beam of the antenna array.

Figure 13:
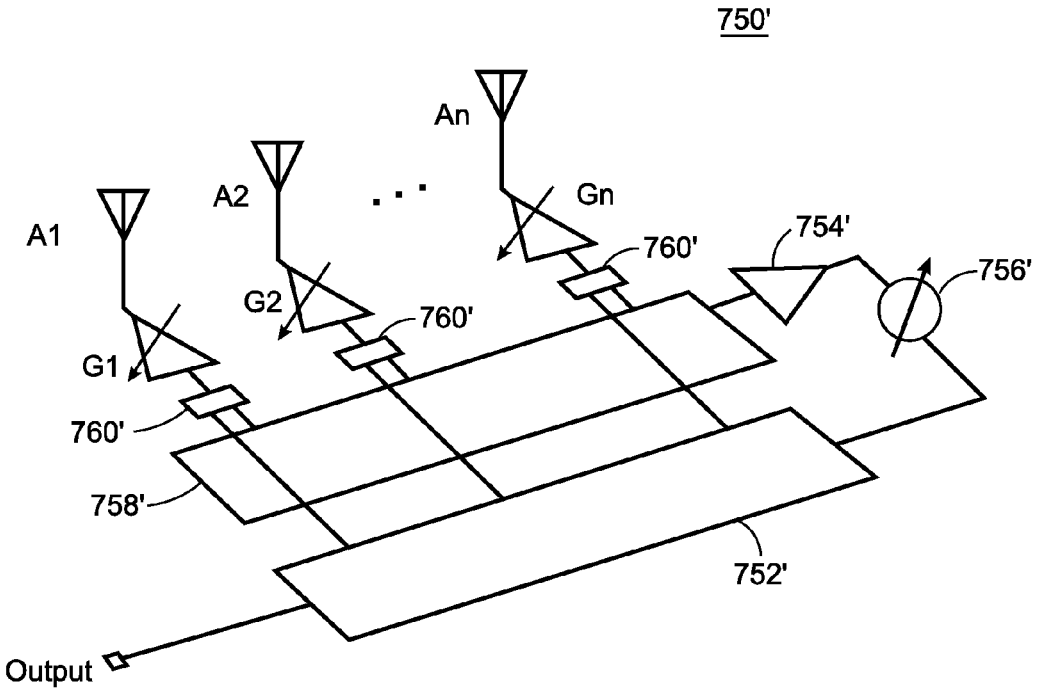
FIG. 13 illustrates another example receive phased array.

As shown more generally in FIG. 13, bearing like reference numerals to that of FIG. 12, a receive phased array 750', is nearly the same as that of the transmit phased array 750, except with the gain amplifiers switched in direction and the combiners replaced with power dividers 760'. The signal received by at each antenna is divided into two components. The first signal components are injected into the first power dividing stage 752' and the second signal components are injected into the second power dividing stage 758'. The first antenna $A_1$ has a larger first signal component and smaller second signal component compared to the second antenna $A_2$ and so on. The second signal components of all the antenna elements are combined through the second power dividing stage 758', amplified through the amplifier 754' (if needed) and injected, through the phase shifter 756', into the first power dividing stage 752'. The phase-shifted signal at the output of phase shifter is then combined with the first signal components of all the antenna elements in the first power dividing stage 752' before producing the received output signal for the device.

Figure 14:
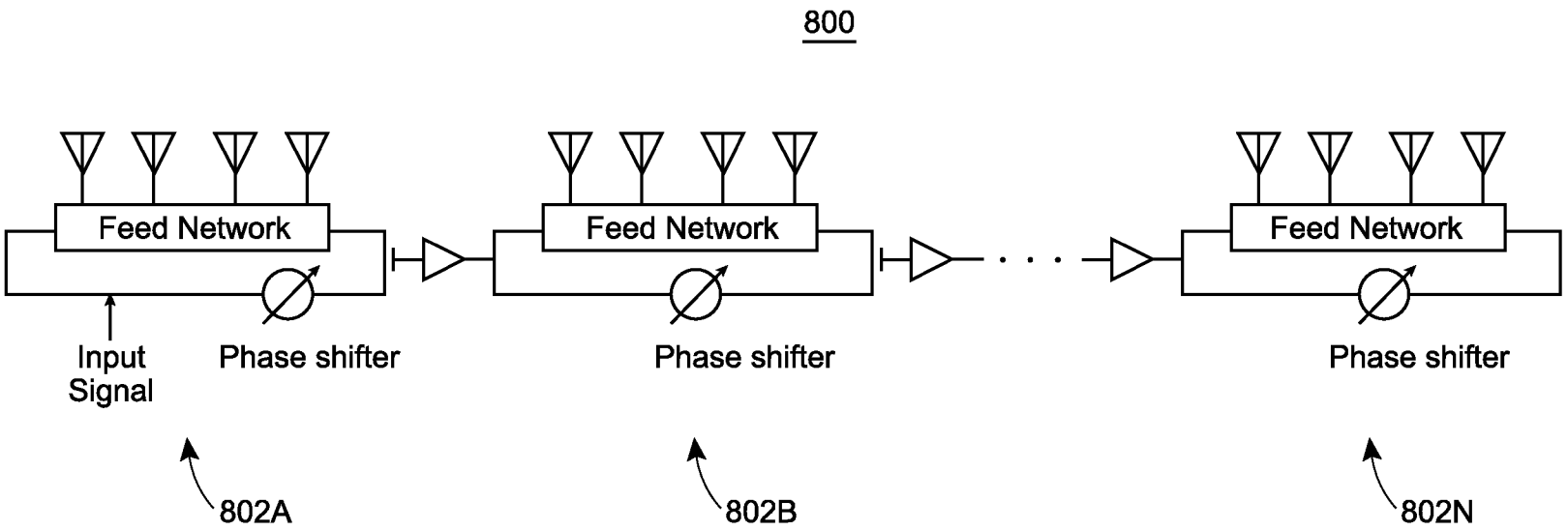
FIG. 14 illustrates an example of a modular phased array design, in accordance with another example.

FIG. 14 illustrates a modular phased array design in accordance with another example, in which the array 800 is formed of numerous modules 802A-802N. For this configuration, the input signal is divided into two components, a non-phased-shifted component and a phase-shifted component. A portion of the phase-shifted signal is coupled, amplified and then injected from the first module 802A into the second module 802N. And this repeats for the next modules as well, until module 802N is reached. Each module 802 is a separate phased array and may be implemented in accordance with any of the configurations disclosed hereinabove.

Figure 15:
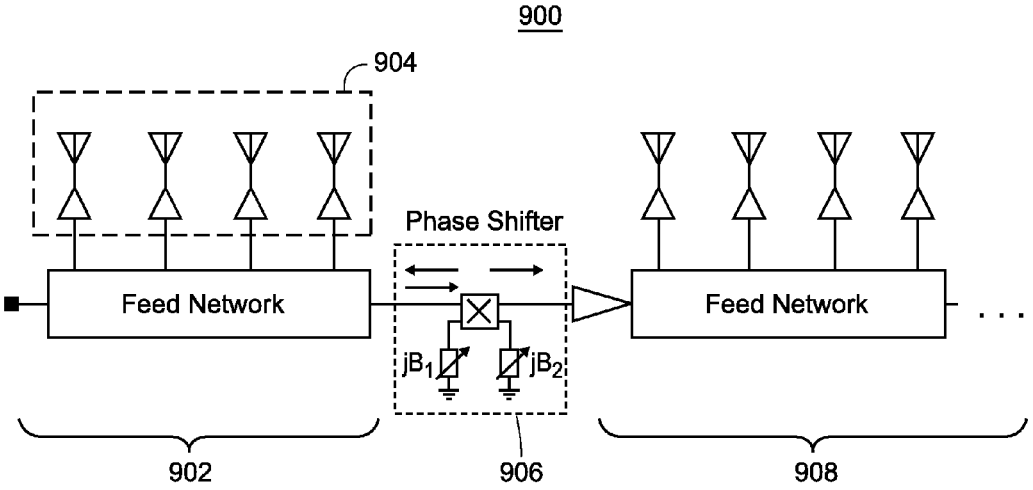
FIG. 15 illustrates yet another example of a modular phased array design.

FIG. 15 illustrates a different modular phased array 900, in accordance with an example of the present techniques. For this configuration, the input signal is applied to a first module 902 having a first feed network as shown. The signal fed into the module 902 is provided to the feed network and coupled to antenna elements 904, e.g., through coupling stages, to generate the first signal components at each antenna. The signal at the last port of the first module 902 is then injected into a phase shifter 906, which produces a phase shifted signal. A portion of the phase shifted signal is injected back into the first module 902 traveling along a second signal path that is opposite the first signal path of the input beam. Another portion of the phase shifted signal is amplified and applied to a second module 908. This process of phase shifting at the end of an antenna module repeats for the next modules (not shown), until the entire array has been excited with a combined input signal. Each module is a separate phased array and may be implemented in accordance with any of the configurations disclosed herein and above.

The techniques described herein may be used in any number of phased array applications, from small size arrays to large size arrays. Examples include automotive applications, radars, landing detection on aircraft, wireless communication networks, portable electronic devices such as laptop computers.

What is claimed:

1. A phased array comprising:

a plurality of antennas;

a feed network comprising a plurality of coupling stages each coupled to a respective one of the plurality of antennas for coupling a respective portion of a first traveling signal to the respective antenna, the first traveling signal traveling in a first direction relative to the plurality of antennas and resulting from an input signal to the feed network; and a tunable phase shifting stage configured to receive the first traveling signal and produce a phase shifted second traveling signal, wherein the tunable phase shifting stage is configured to tunably adjust the phase of the second traveling signal resulting from the first traveling signal to scan a beam produced by the phased array, wherein the second traveling signal travels in the feed network in a second direction relative to the plurality of antennas, the second direction being opposite the first direction of the first travelling signal, such that each coupling stage couples a respective portion of the second traveling signal and the respective portion of the first traveling signal to the respective antenna for that coupling stage.

2. The phased array of claim 1, wherein each coupling stage comprises an amplifier, the amplifier being configured to amplify the portion of the second traveling signal.

3. The phased array of claim 1, wherein the phased array is in a transmission configuration and each coupling stage comprises a combiner combining the two signal components to produce a combined input signal for the respective antenna.

4. The phased array of claim 1, wherein each coupling stage further comprises a tunable amplifier for amplifying the combined input signal.

5. The phased array of claim 1, wherein the input signal is an electrical input signal, the first traveling signal and the second traveling signal are electrical signals, and the tunable phase shifting stage is configured to tune the phase of the second traveling signal, produced from the first traveling signal, by varying the phase of second traveling signal.

6. The phased array of claim 1, further comprising:

a bias network controller coupled to the tunable phase shifting stage and configured to provide a control signal to tunably adjust the phase of the second traveling signal resulting from the first traveling signal.

7. A phased array comprising:

a plurality of antennas;

a feed network comprising a plurality of coupling stages to superimpose respective portions of two signals travelling in opposite directions, wherein the two signals are produced by (i) splitting an input signal of the phased array and (ii) feeding to the feed network from two opposite ends of the phased array each of the two signals respectively; and a tunable phase shifting stage to control the relative phase shift between the two signals travelling in the feed network, wherein the tunable phase shifting stage is configured to tunably adjust the relative phase shift of the two signals traveling in the feed network to scan a beam produced by the phased array.

8. The phased array of claim 7, wherein each coupling stage comprises a tunable amplifier for amplifying the superimposed signal for the coupling and to produce the input signal to the antenna.

9. The phased array of claim 7, further comprising:

a bias network controller coupled to the tunable phase shifting stage and configured to provide a control signal to control the relative phase shift between the two signals travelling in the feed network.

10. A phased array comprising:

a plurality of antennas;

a electrical feed network coupled to the plurality of antennas to receive a electrical signal from each antenna and to split the received signal from each antenna into a first component and a second component and to combine a respective portion of each of the first component and the second component, wherein the respective portion of the first components from the plurality of antennas are coupled into a feed line of the feed network and combined coherently traveling in a first direction and wherein the second components from the plurality of antennas are coupled into the feed line and combined coherently traveling in a second direction opposite to the first direction; and a tunable phase shifting stage positioned to apply a phase shift to the combined second components, relative to the combined first components, at one of the two ends of the feed network.

11. The phased array of claim 10, wherein the feed network comprises a plurality of coupling stages that each further comprises a power combiner to combine the signals of the two opposite ends of the feed network.

12. The phased array of claim 11, wherein each coupling stage comprises a tunable amplifier for amplifying the received signal from antennas.

13. A repeatable phased array element comprising:

an array module comprising a plurality of antennas and a electrical feed network coupled to the array module and configured to combine a forward traveling input electrical signal and a reverse traveling, phase shifted input electrical signal as combined input signals supplied to each of the plurality of antennas respectively; and a tunable phase shifter stage to phase shift a portion of the forward travelling input electrical signal at one end of the feed network and (i) to inject the portion of the forward traveling input electrical signal in a reverse direction into the feed network as the reverse traveling electrical signal, if no subsequent array module is connected to an output of the phase shifter stage, and (ii) inject a remaining other portion of the forward traveling input electrical signal into a subsequent array module if a subsequent array module is connected to an output of the phase shifter stage.

14. The repeatable phased array element of claim 13, wherein the feed network comprises a plurality of combiners to combine the forward traveling input signal and the reverse traveling, phase shifted input signal.

15. The repeatable phased array element of claim 13, further comprising tunable amplifiers for each of the plurality of arrays for individually and controllably amplifying the respective combined input signals for each of the plurality of arrays.

* * * * *